US010737226B2

(12) United States Patent
Trahan et al.

(10) Patent No.: US 10,737,226 B2
(45) Date of Patent: Aug. 11, 2020

(54) HIGH EFFICIENCY POWDER DISPERSION AND BLEND SYSTEM AND METHOD FOR USE IN WELL COMPLETION OPERATIONS

(71) Applicants: David O. Trahan, Lafayette, LA (US); Richard E. Trahan, Lafayette, LA (US)

(72) Inventors: David O. Trahan, Lafayette, LA (US); Richard E. Trahan, Lafayette, LA (US)

( * ) Notice: Subject to any disclaimer, the term of this patent is extended or adjusted under 35 U.S.C. 154(b) by 0 days.

(21) Appl. No.: 16/664,311

(22) Filed: Oct. 25, 2019

(65) Prior Publication Data

US 2020/0129934 A1 Apr. 30, 2020

Related U.S. Application Data

(60) Provisional application No. 62/751,359, filed on Oct. 26, 2018.

(51) Int. Cl.

| | |
|---|---|
| ***B01F 3/12*** | (2006.01) |
| ***B01F 5/04*** | (2006.01) |
| ***B01F 15/00*** | (2006.01) |
| ***B01F 15/02*** | (2006.01) |
| ***B01F 3/20*** | (2006.01) |
| ***E21B 41/00*** | (2006.01) |

(52) U.S. Cl.

CPC ..... *B01F 3/1271* (2013.01); *B01F 3/2028* (2013.01); *B01F 5/043* (2013.01); *B01F 5/0426* (2013.01); *B01F 15/00194* (2013.01); *B01F 15/00961* (2013.01); *B01F 15/00974* (2013.01); *B01F 15/0202* (2013.01); *B01F 15/026* (2013.01); *B01F 15/0235* (2013.01); *B01F 15/0251* (2013.01); *B01F 15/0259* (2013.01); *B01F 15/0283* (2013.01); *E21B 41/00* (2013.01); *B01F 2003/125* (2013.01); *B01F 2215/0081* (2013.01)

(58) Field of Classification Search

CPC ..... B01F 3/1271; B01F 5/043; B01F 3/2028; B01F 15/0251; B01F 5/0426; B01F 15/00194; B01F 15/0283; B01F 15/0235; B01F 15/0202; B01F 15/026; B01F 15/0259; B01F 15/00974; B01F 15/00961; B01F 2003/125; B01F 2215/0081; E21B 41/00

See application file for complete search history.

(56) References Cited

U.S. PATENT DOCUMENTS 4,186,772 A 2/1980 Handleman
4,406,410 A * 9/1983 Larson ..... B01F 13/02 241/101.8

(Continued)

*Primary Examiner* — Tony G Soohoo

(74) *Attorney, Agent, or Firm* — Matthews, Lawson, McCutcheon & Joseph, PLLC

(57) ABSTRACT

An improved system and method for fluidizing dry powder-based additives into downhole well operations utilizes a dried, low-volume air stream and an ejector nozzle in order to disperse the powders into a liquid stream. In an embodiment, the system can be placed on a powder blending trailer in order to convey additives directly from bulk transport bins into a liquid stream, through the use of an atmospheric pressure hydration tank fitted with a cyclone separator to ensure an even dispersal into the liquid stream.

14 Claims, 6 Drawing Sheets

(56) References Cited

U.S. PATENT DOCUMENTS 4,430,001 A * 2/1984 Schurr ..... B01F 5/0405 366/101
4,603,156 A 7/1986 Sortwell
4,643,582 A * 2/1987 Ricciardi ..... B01F 3/1228 222/195
4,685,810 A * 8/1987 Sakuichi ..... B28C 7/062 366/10
4,725,379 A * 2/1988 Baumgartner ..... B01F 1/00 507/213
4,801,210 A * 1/1989 Gian ..... B01F 13/10 366/10
4,884,925 A 12/1989 Kemp et al.
5,044,819 A * 9/1991 Kilheffer ..... E01C 19/46 177/119
5,213,414 A 5/1993 Richard et al.
5,284,388 A * 2/1994 Volk ..... A21C 1/143 366/141
5,328,261 A 7/1994 Castano
5,407,299 A * 4/1995 Sutton ..... B28C 9/04 366/2
5,634,713 A * 6/1997 Abe ..... B01F 13/0211 366/102
6,193,402 B1 * 2/2001 Grimland ..... B01F 3/1221 366/14
6,402,068 B1 * 6/2002 Handleman ..... B01F 5/0413 241/39
6,796,704 B1 * 9/2004 Lott ..... B01F 3/12 366/163.2
6,994,464 B2 * 2/2006 Villwock ..... B01D 19/0052 366/136
7,325,967 B2 * 2/2008 Hoff ..... A01K 5/0216 366/141
7,410,078 B2 * 8/2008 Hoff ..... A01K 5/0283 222/1
7,413,388 B2 * 8/2008 Krebs ..... B65G 53/08 406/120
7,537,375 B2 * 5/2009 Hoff ..... A01K 5/0216 366/141
8,079,750 B2 * 12/2011 Freeman ..... A01K 5/0216 141/1
8,322,911 B2 12/2012 Pich et al.
8,905,627 B2 12/2014 Noles, Jr.
9,067,182 B2 6/2015 Nichols et al.
9,132,395 B2 9/2015 Schauerte et al.
9,782,732 B2 10/2017 Noles, Jr.
2004/0256106 A1 12/2004 Phillippi et al.
2009/0044726 A1 * 2/2009 Brouillette ..... B28C 9/0463 106/706
2010/0220549 A1 * 9/2010 Holdsworth ..... B65G 33/22 366/167.1

* cited by examiner

HIGH EFFICIENCY POWDER DISPERSION AND BLEND SYSTEM AND METHOD FOR USE IN WELL COMPLETION OPERATIONS

REFERENCE

This is a non-provisional patent application claiming priority to U.S. Provisional Application No. 62/751,359, filed 26 Oct. 2018, with the same title and inventors. The contents of this provisional application are fully incorporated herein by reference.

FIELD

The present invention relates to a mobile polymer blend method and apparatus for blending one or more water-soluble powdered polymer(s) and chemicals into fresh or non-fresh water at well drilling, completion or fracture locations. The polymer powder can include a wide assortment of polymer additives less than 400 micrometers in particle size which are typically used in such operations. The powdered chemicals may comprise scale inhibitors, corrosion inhibitors, biocides, surfactants, iron control agents, polymer breakers, and other powdered chemical products used in liquid applications.

The process and apparatus comprises a mobile powder blending trailer and an air compressor with an air dryer, connected via a powder conduit between the powder outlet of the mobile powder blending trailer and the powder bin located on the mobile powder blending trailer. The inventive method uses an annular liquid drive ejector to evenly and efficiently commingle and disperse the polymer within a stream of water. The annular liquid drive ejector applies a mechanical and hydraulic shearing action to the powdered polymer and/or chemical which aids in the powder dispersion and prevents the forming of agglomerated non-hydrated powder particles in the liquid. These agglomerated and non-hydrated powder particles are also commonly called "fish eyes." Once the powder and liquid are combined, the liquid-powder blend is discharged directly from the discharge port of the annular liquid drive ejector into an atmospheric pressure liquid vessel located downstream. The downstream liquid vessel is open to the atmosphere via an open top or an open access port of sufficient dimension so as to allow the air used to convey the powder to the ejector nozzle to be released in an unrestricted manner to the atmosphere or out of the liquid.

The air used to convey the powder from the mobile powder blending trailer into the powder bin is discharged from the top of the mobile trailer powder bin once it is filtered in order to remove any residual powder particles remaining in the transfer air from entering the environment. The powder ejection and mixing system is constructed to be mounted on a stationary or transportable skid, or mounted on a mobile trailer for easy transportation and delivery to the well site. The flow of powder and water are metered separately, and their flow is monitored and controlled by operators, or one or more onboard electronic process controllers displaying system information locally on a control panel and transmitting remotely to operations personnel by way of a cellular, internet, or satellite communication network connection.

BACKGROUND

Oilwell drilling and well completion operations use an assortment of chemical additives, including polymeric chemical additives, to provide various effects including higher viscosity to water and reduction of hydraulic friction in well pumping operations. The global expansion of hydraulic fracturing relies upon a dependable source of chemical and polymer additives in order to function. The present invention relates to a method and apparatus for blending water-soluble dry powdered chemical additives into fresh water or non-fresh water. Chemical products are used in drilling, completion and fracture operations to achieve many different functional outcomes. It is common for well service operators to use water-soluble and/or water-dispersible chemical additives in the form of liquid or powdered chemicals or liquid-powder suspensions for easier dispensing, metering and addition to water-based liquid systems. As an example, small size powdered polymers such as polymeric polyacrylamide friction reducers and other polymeric viscosity additives have been replaced in many well operations and treatment applications with oil-in-water emulsion-based products, which offer operators an easier and consistent addition of chemical additives into the working liquid. Liquid high molecular weight polyacrylamide polymers are delivered as water-in-oil liquid emulsion. The liquid polyacrylamide emulsions are typically made by polymerizing an acrylamide monomer in an oil consisting of a hydrocarbon containing emulsifying surface-active or other types of chemical agents to create an oil-in-water emulsion, with the active polymer contained within aqueous droplets evenly dispersed in an oil carrier. The polyacrylamide emulsion is dispersible in water. In order to function properly the polyacrylamide emulsion must first be inverted or "broken" through addition or dilution of water and strong agitation. As the polymer is already dissolved within the aqueous phase of the emulsion, maximum friction reduction and viscosity building performance is expected to occur much more rapidly than in the addition of a dry powder polymer product. The emulsion products are designed to be less active than powders resulting in more handling and freight associated with their use.

The invention is not limited to working solely with friction reducers and/or viscosity building polymers. A wide variety of chemical additives are commonly used in well drilling, completion and fracture operations. Just as with the friction and viscosity polymers, the other chemical additives are commonly delivered to well site as lower-activity water-soluble liquid products. There are measurable and meaningful cost-savings advantages to using powdered chemical additives versus using products delivered as liquids, such as lower handling and freight costs for delivery and storage at the well site. Additionally, liquid chemical products delivered to well site in bulk shipping containers are more susceptible to leakage or spillage than products delivered as powders. Liquid chemical spills create possible exposure issues to workers and environmental cleanup hazards.

Powders used in oil well operations have typically been delivered in bags of various volumetric amounts. The smaller size chemical powder bags are 50 pounds and 100 pounds, normally handled by workers, and poured directly into the liquid container equipped with mixing equipment, such as a rotating blending propeller or circulating pump system, or the powder is poured into an eductor style powder induction system in line with all or a portion of the liquid flowing through the eductor. When powder is added into a liquid blend tank there is a period of time required to sufficiently hydrate and dissolve the powder. The typical eductor device is based upon the Venturi principle where a pump pressurizes the liquid directed into the eductor. When the liquid exits the eductor orifice, it is released into a lower pressure environment which creates a vacuum in the body of the eductor, downstream of the eductor orifice. A powder is poured into an overhead receptacle above the eductor body, where it is drawn by gravity and the vacuum created from the pressurized flow of liquid through the eductor orifice into the eductor body where it combines with the liquid flow. There are several limitations associated with the use of this type of traditional eductor blending system. Manually pouring the powders into the eductor overhead receptacle can lead to premature liquid wetting causing plugging of the eductor suction section, resulting in inconsistent feed rate. Any disruption requires a system shutdown and maintenance to clear any blockage in the suction section of the eductor.

Further, the traditional powder eductor apparatus and blending methods require considerable operator effort to accurately meter powdered chemical products into a flowing liquid system. It is more common for the traditional eductor methods to involve batch addition of known weights of powders into a given volume of liquid rather than a dynamic addition of powder based upon moment-to-moment system requirements. The traditional eductor powder addition method makes it more difficult for operators to accurately meter powders into a continuous flow of liquid. This invention meets the need for a much improved, low cost, efficient, accurate method and apparatus for powder addition into a flowing liquid stream. The unique invention combines several techniques and apparatuses to make it possible to evenly disperse and dissolve powders into liquids in a continuous manner. The invention makes it much easier for operators working at well drilling, well completion, and well fracturing operations to use powdered chemical additives rather than liquid chemical additives in their liquid systems. The use of powder chemical additives offers a more safe, economical method of treating liquids and minimizes the potential for leakage of chemicals into the environment.

There are several commercial powder dispersion systems in the market used for dispensing and dissolving a range of powdered chemical products into water. The present invention provides an improved method and apparatus for adding powdered chemical additives and then blending the powder into water or other liquid at volume.

The addition of hydratable polymeric powders into water systems at high volumetric flow rates presents special problems for well service operators. If the powder is added too quickly it will only partially hydrate in the water or liquid, resulting in reduced product performance. Blending difficult-to-hydrate polymers at high addition rates into water and liquid systems places special challenges on powder addition and blending systems. The present invention overcomes these problems and is capable of high rates of addition of water-hydratable polymer powders, such as high molecular weight polyacrylamide friction reducers and other polymeric-type viscosity additives, into water systems without creating gelled "fish eyes" of agglomerated solids in the water or liquid. When hydratable polymer powders are highly hygroscopic and improperly dispersed, they tend to form small partially hydrated polymer particles encapsulated in highly viscous, partially hydrated gel. The existence of partially hydrated fish eyes in well service water or liquids is unacceptable for well site operations. Commercially available powder dispersion systems use high energy/shear dispersion mechanisms, liquid shearing pumps and/or centrifugal pumps, to prevent the hydratable powder from forming fish eyes. However, there are drawbacks to using high energy mixing systems. In the case of high molecular weight polymers which are used in water or liquid systems, the polymer can be mechanically sheared, damaging the physical characteristics and performance properties of the powder after it is solubilized into the water or liquid. This is especially true with viscosity building and friction reducing high molecular weight polyacrylamides in water.

The typical powder eductor mixer relies on the force and volume of liquid flowing through an internal eductor nozzle to create a negative pressure or vacuum immediately downstream of the point in which the liquid exits the nozzle. The vacuum is used to draw or suck the powder into the eductor body downstream of the eductor nozzle, and mix into the liquid flowing out of the eductor nozzle. In typical eductor operations the liquid is pumped through a nozzle of a smaller diameter than the pipe or liquid conduit, so it produces a release point of a high velocity stream of water or liquid. The high velocity liquid stream creates a lower pressure zone around the downstream end of a nozzle. The system relies on this low-pressure region to cause the powder to be drawn or sucked from a powder hopper or container located above the eductor body through a suction port into a mixing chamber in the downstream pipe section. The suction is created due to Venturi effect that results in a drop in pressure at the tip of the nozzle due to the fast flowing motive liquid which has gained kinetic energy due to the tapered shape of the nozzle.

Examples of prior art patents utilizing eductor or mechanical mixing processes include U.S. Pat. Nos. 9,782,732, 9,132,395, 8,905,627, 9,067,182, 8,322,911, US Pub. No. 2004/0256106, U.S. Pat. Nos. 5,328,261, 5,213,414, 4,603,156, 4,186,772, and 4,884,925.

Another limitation of current conventional mobile powder dispersion system involves the powder handling and feed system. Many of the commercial systems use gravity-fed hopper systems attached to a mechanical feed system, conveyor or screw feeder. Many of the chemical powders used in well operations are hygroscopic, water-seeking, and easily absorb atmospheric moisture, becoming "sticky" and difficult to flow. When working with friction reducing polyacrylamide-based polymers, the atmospheric moisture can cause the polymer to build up on the internal surface of handling equipment and hoses it comes in contact with, resulting in the interruption in normal operations.

SUMMARY OF THE INVENTION

It is a feature of the current invention to deliver all powders to the well site in specially engineered metal or polymer constructed powder bins or in bulk powder trailers. The powder bins or bulk powder trailers are preloaded with the powdered chemical products at an offsite location using a dry air conveying system to minimize water absorption in the powders. At the well site, the powdered chemical products are dispensed from their individual powder bins or bulk powder trailer using one or more pneumatic powered twin diaphragm pumps or using a constant flow of dry air to convey the powder into the powder bin located on the mobile powder blending trailer.

Weight measurement devices are installed on the powder transfer tanks on the powder application trailer which measure the change in weight corresponding to increase or decrease of powder. Optionally, an inline coriolis mass flow meter is mounted in the powder transfer line and is used to accurately measure the weight and volume of the powder as it moves from transport container to powder transfer tanks on the mobile powder blending trailer. The powder is delivered from the powder transfer tanks to the powder dispersion nozzle assembly using single or multiple screw feed system. The invention uses a pressurized air stream to convey the polymer or chemical powder from the powder bin to the annual liquid drive ejector.

It's a feature of this invention that when transferring and metering hydratable polymer and chemical powders the apparatus will use air with a low dew point to avoid water absorption of powder. The preferred dew point for the air used to convey powders is −40° C. (−40° F.). At this dew point level, the air is considered adequately dry and free from moisture to avoid unacceptable hydrating of water sensitive powders. The current invention may be equipped with a continuous dew point measurement sensor connected to an electronic control system capable of sending a signal to the air system to interrupt the flow of air in order to avoid unacceptable moisture level in the air used to convey the powder to the annular liquid drive ejector apparatus.

DRAWINGS

In the detailed description of embodiments usable within the scope of the disclosure, presented below, reference is made to the accompanying drawings.

DETAILED DESCRIPTION OF THE EMBODIMENTS

Before describing selected embodiments of the present disclosure in detail, it is to be understood that the present invention is not limited to the embodiments described herein. The disclosure and description herein is illustrative and explanatory of one or more presently preferred embodiments and variations thereof, and it will be appreciated by those skilled in the art that various changes in the design, organization, order of operation, means of operation, equipment structures and location, methodology, and use of mechanical equivalents may be made without departing from the spirit of the invention.

As well, it should be understood the drawings are intended to illustrate and plainly disclose presently preferred embodiments to one of skill in the art, but are not intended to be manufacturing level drawings or renditions of final products and may include simplified conceptual views as desired for easier and quicker understanding or explanation. As well, the relative size and arrangement of the components may differ from that shown and still operate within the spirit of the invention.

Moreover, it will be understood that various directions such as "upper," "lower," "bottom," "top," "left," "right," and so forth are made only with respect to explanation in conjunction with the drawings, and that the components may be oriented differently, for instance, during transportation and manufacturing as well as operation. Because many varying and different embodiments may be made within the scope of the concept(s) herein taught, and because many modifications may be made in the embodiments described herein, it is to be understood that the details herein are to be interpreted as illustrative and non-limiting.

Figure 1:
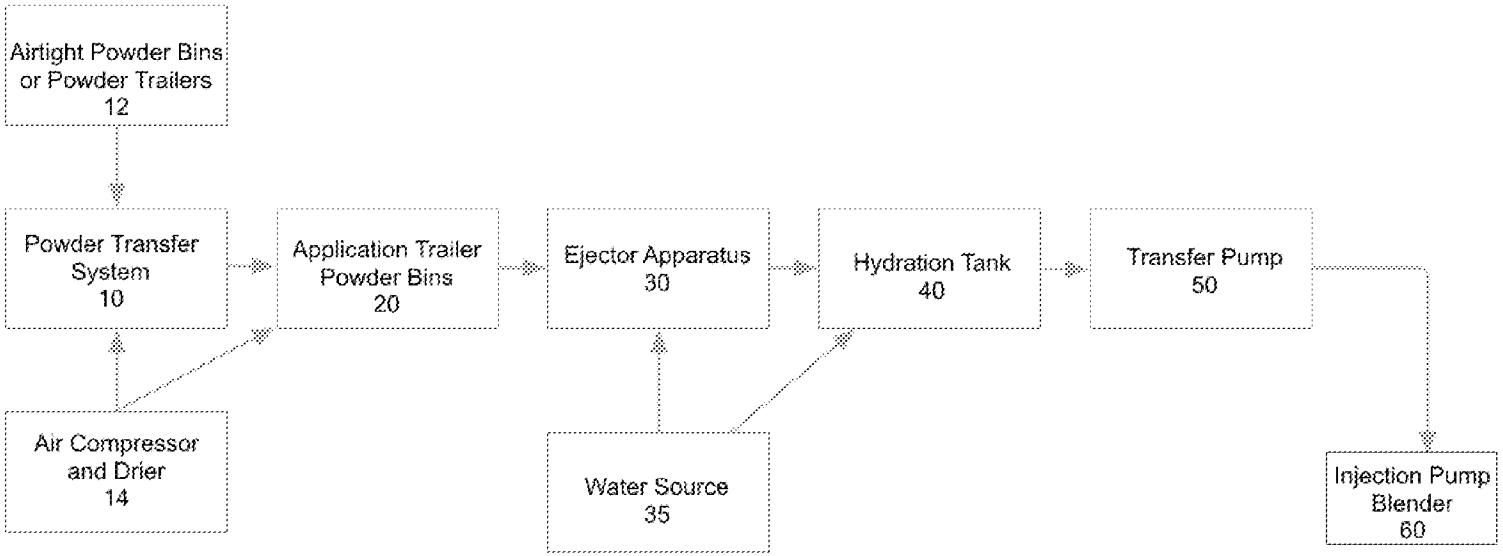
FIG. 1 depicts a generalized process flow of a method embodiment of the present invention.

Turning first to FIG. 1, an abstracted flowchart of an embodiment of the powder transfer system 10 is depicted. In an embodiment, the powder is delivered to well site in metal or plastic air tight powder bins 12 on truck flatbed trailers or air tight bulk powder trailers 12. The powder containers 12 are constructed with angular or round cone bottoms with the cone section oriented at a minimum angle of 65 degrees of inclination to improve powder flow down and out of powder bins. The powder containers are fitted with one or more air lines at or near the base of the powder bins connected to an air compressor and drier 14. Low-pressure air is delivered into the powder container 12 to fluidize powder contents and condition the powder for transfer to the powder bins of the application trailer 20. Fluidization of powder in the powder containers 12 transitions powder from a static powder into a liquefied condition whereby a powder or granular material is converted from a static solid-like state to a dynamic liquid-like state. This process occurs when the air is passed up through the granular or powder material. The fluidized powder is then conveyed to the ejector apparatus 30, which blends the solid powder with water from a water source 35, at which point the water-powder mixture is discharged at a high velocity into an atmospheric vessel or hydration tank 40, where additional mixing may occur by circulating the received liquid back into the atmospheric vessel using a pump or by means of mechanical agitators positioned within the liquid. As an option the water leaving the ejector device containing the powder may be diluted with an additional volume of liquid added into the atmospheric vessel or hydration tank 40 in order to further aid in the hydration of the polymer or chemical additives. A transfer pump 50 conveys the water-powder mixture from the hydration tank 40 to an injection pump 60 which further acts as an in-line blender.

Figure 2:
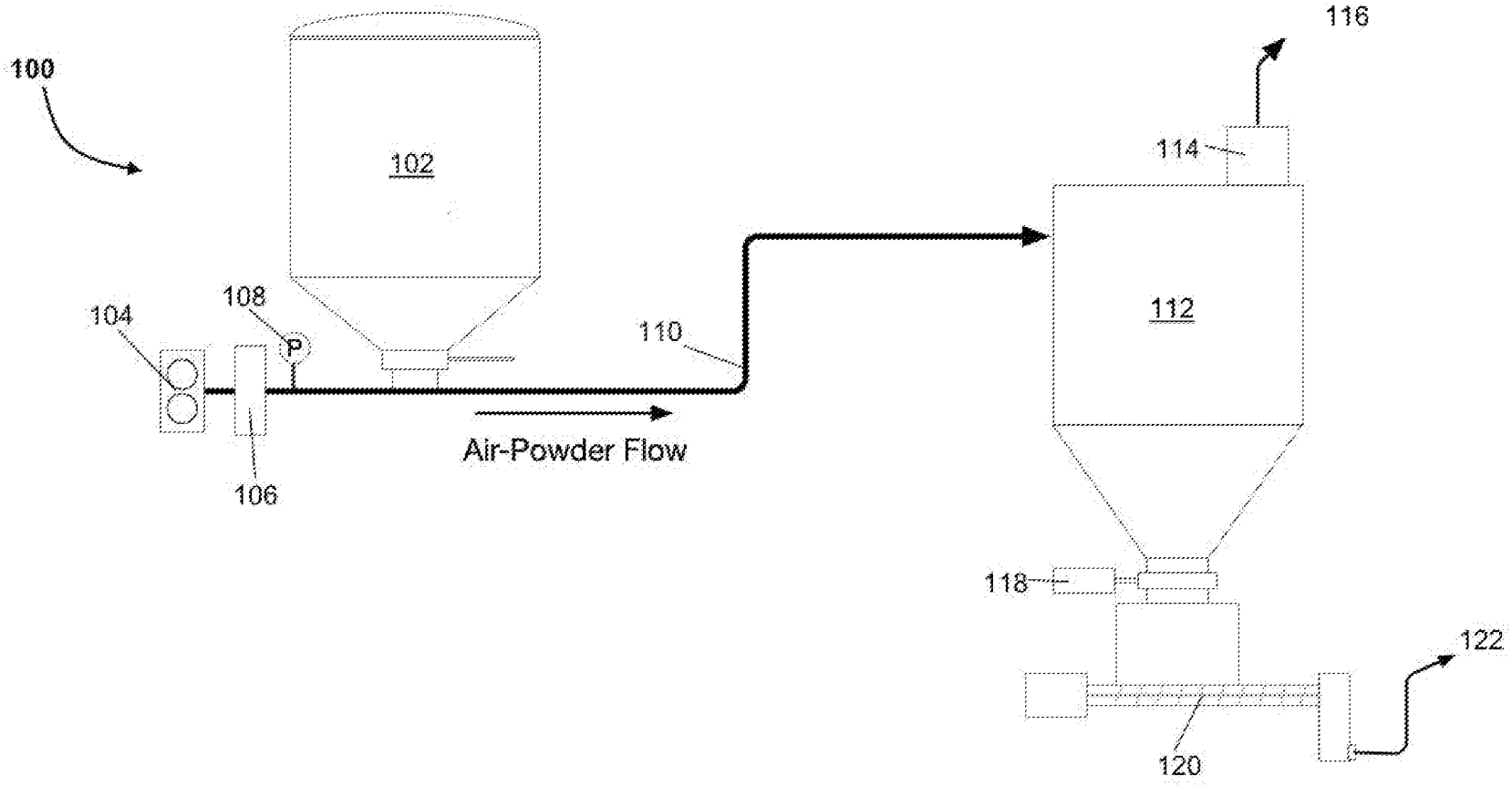
FIG. 2 depicts a system embodiment of the mobile transport and transfer elements of the present invention.

Turning now to FIG. 2, an embodiment of the first stage of the system 100 is depicted. The powder in the powder transport bins or trailers 102 is moved from the transport powder container(s) 102 into the powder transfer bins 112 located on the powder blend trailer using a given flow of ambient or dry air 110. The increase in measured weight of the powder transfer bins 112 provides weight gain or weight loss information which is recorded by the local onboard and/or remote electronic controller so as to provide a record of the amount of powder delivered to the powder application trailer powder bin. The powder application trailer is fitted with one or more powder transfer bins 112 so as to isolate the active powder transfer tank during powder application operations.

The current invention uses a powder storage container 102 fitted with a low volume air stream 110 injected at the base of the powder storage container 102 to condition and fluidize the polyacrylamide polymer (or other suitable powder additive) for transfer to the powder bin 112. The air or gas passing up through the powder bin 112 to fluidize the granular or powder material is directed out of the powder bin 112 into a filtration apparatus 114 to remove any residual powder particles therefore preventing the powder from being released into the environment through air exhaust 116. Once the powder is conditioned it is conveyed as a dispersed air-powder stream in a flexible or rigid, smooth bore conduit 110 to the powder bin 112 on the application trailer and from the powder bin 112 on the application trailer to a conduit 122 leading to the powder dispersion ejector device. The conduit system may be initially charged with an extremely dry air stream provided by an air compressor 104 and dryer 106.

Supplemental air may be added to the air-powder conveyance conduit 110 to quickly charge and dry the powder conduit system during and between powder conveying cycles. The use of dry air helps to remove any moisture which may enter the powder conduit from the atmosphere or from water used in system cleaning operations. A continuous dew point measurement sensor 108 can allow the operator or electronic controller to monitor the humidity of the air to ensure proper fluidization.

The motive force for the powder transfer from the transport container 102 to the onboard powder bin 112 or vessel is a combination of pressure produced by a blower or compressor 104 and the pressure differential created by the flow of air through an eductor, or similar device downstream. The use of a compressor or blower 104 is determined by the pressure required for the powder to be adequately conveyed; a pneumatic system with an air compressor is used for powders requiring pressures greater than possible with the use of a centrifugal fan or rotary blower. If the powder requires dry gas to avoid becoming sticky and possibly clogging up the air-powder conduit, the air compressor discharge flows into a dryer assembly 106 containing water absorbing material such as a zeolite. Zeolite removes moisture by adsorption and can reduce the dewpoint of the air down to a lower dewpoint of −30° C. to −40° C.

Figure 3:
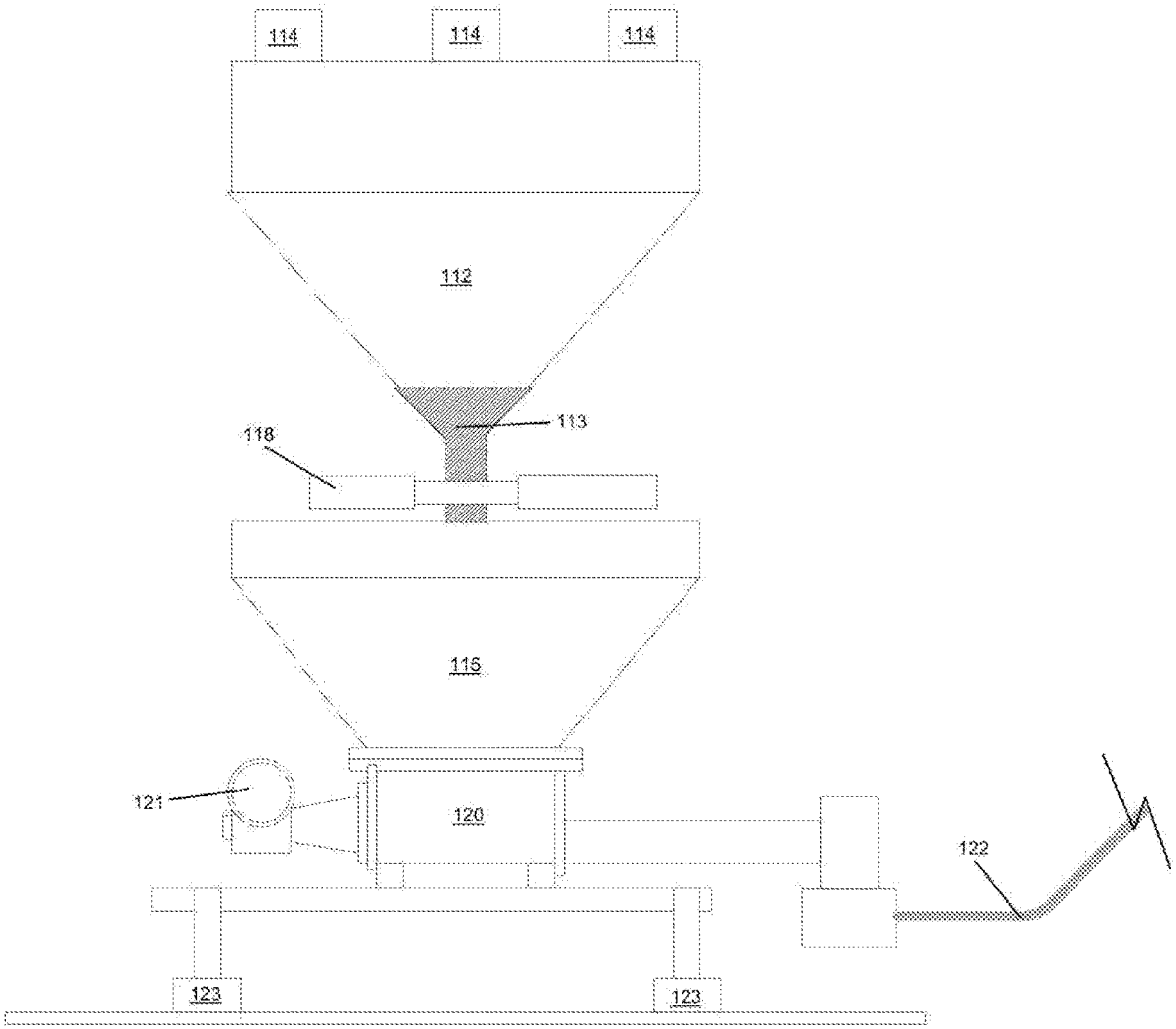
FIG. 3 depicts an embodiment of the powder bin for use with the present invention.

Turning now to FIG. 3, the chemical additive powders are conveyed into the powder conduit 122 from the powder bins 112 via a powder feed hopper 115. The powder is kept in a fluidized state in powder bins 112 by means of an air-powder conditioner 113 blowing air up through the mobile powder bin 112, and through filters 114 which ensure the powder does not escape to the ambient environment through the exhaust. The volume of powder transferred from the transport containers 102 to the mobile powder blending trailer powder bins 112 is measured by recording the increase in weight of the powder bins 112 located on the mobile powder blending trailer. In an embodiment, each application trailer powder bin is equipped with one or more weight measuring devices including a load cell 123 or density probe; the weight values measured by the load cells 123 or density probes may be read directly by operators or recorded by an onboard and/or remote electronic controller to record the weight and to record any increase or decrease change in weight of individual powder bins.

Each of the powder bins is fitted with one or more air-powder conditioners 113 located near the base of the powder bin 112. The conditioners 113 release a small, controlled volume of air into the base of the powder bin to disperse or condition the powder to flow out of the container like a liquid. The fluidized powder within the powder bin 112 flows more freely through a slide gate valve 118 and an optionally installed air lock valve (depicted in FIG. 4) into the powder metering screw feed device 120 driven by a variable speed electric motor 121 before being conveyed by a vacuum out and into a conduit 122 leading to the annular liquid drive ejector device. A free-flowing dry powder allows for greater accuracy of powder metering. The rate of feed of the powdered chemical agent to the ejector device is optionally monitored with a flowmeter (not shown) and controlled by an onboard electronic controller to adjust the release of a preset amount of powder into the water or liquid. The local electronic controller software is capable of translating the feed rate into several different rate measurement units for reporting to local and remote operators including pounds per minute, pounds per 1,000 gallons of liquid, or pounds per barrel of liquid, and these conversion results are reported locally on one or more visual electronic control panels or portable communication devices such as a smart phone or computer tablet.

Figure 4:
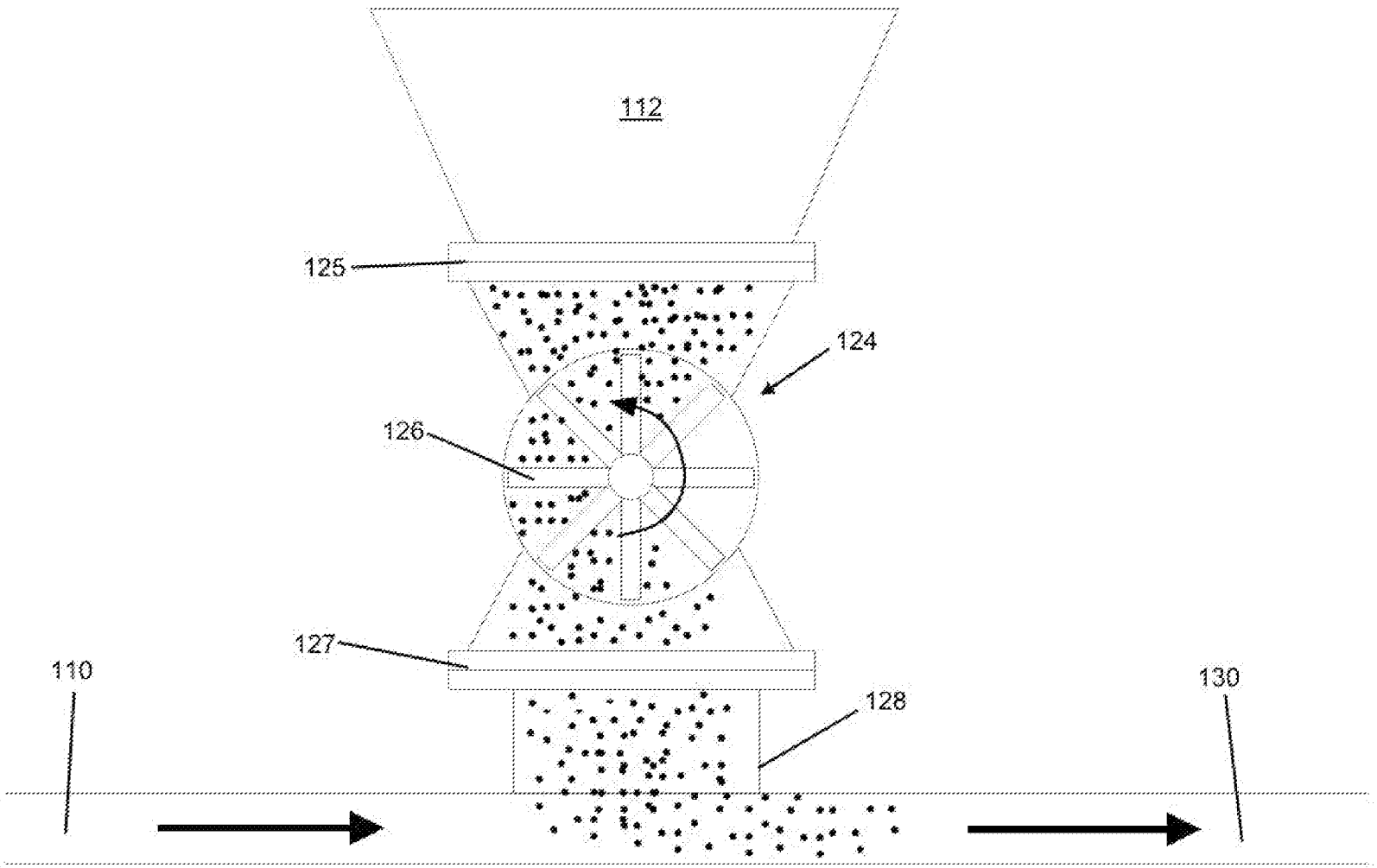
FIG. 4 depicts an embodiment of the rotary air lock valve for use with the present invention.

Turning now to FIG. 4, the current invention can optionally use one or more rotary air lock valves 124 fit to the powder outlet of the transfer containers 112. Rotary air lock valves 124 are used in powder conveying systems to provide consistently metered amounts of powders into an air conveying system or receptacle. The rotary air lock valves 124 are used to efficiently discharge bulk powder and materials from transfer containers 112 into positive or negative pneumatic conveying systems 128. Rotors 126 have vanes cast or welded on and are typically driven by an electric motor, hydraulic motor, or air powered motor. These provide a separation of the powder bin 112 and the powder conduit 128. Each revolution of the air lock valve 124 delivers a given volume of powder into the powder conduit 128. Optionally, the air lock valve 124 is filled with low-pressure air from the air conveying system to purge powder from the cavity between the rotor shroud and the housing end plates 125, 127. The air serves two purposes: to prevent dust from reaching the shaft packing and blowing off material that would attempt to settle in the air lock valve 124. The air conveying system of the current invention transfers powders through a closed-circuit conduit 130 or piping system preventing escape of powder into the environment upstream of it before being dispersed into water or another liquid.

The energy needed to move the powder from the powder bin to the ejector device is supplied by the vacuum created by pressurized liquid flowing through the ejector orifice or nozzle. The conditioned or fluidized powder is conveyed via a conduit or pipe to the point where maximum vacuum is applied, drawing the powder into the ejector device where it combines directly with the flowing liquid as it travels through the annular space surrounding the ejector device. An onboard electronic controller regulates the flow of air-powder mixture and monitors the positive and negative pressures within the powder conveying system. At a point upstream of the ejector device, the air-powder mixture flows through an electronic coriolis meter which accurately measures the flow of powder to the ejector device. The basic operation of a coriolis flow meter is based upon the principles of motion mechanics. When a liquid enters the sensor, it is split. During operation, a drive coil stimulates the tubes to oscillate in opposition at the natural resonant frequency. As the tubes oscillate, the voltage generated from each pickoff creates a sine wave. This indicates the motion of one tube relative to the other. The time delay between two sine waves is called delta-T, which is directly proportional to the mass flow rate. The coriolis meter data is collected and stored in real time by an onboard electronic controller. The onboard electronic controller can direct the rate of powder addition based upon pre-determined values input by the operator locally or remotely.

The powder is delivered to the ejector device where it effectively distributes the powder into the liquid. The ejector device is unique in directing particles into a liquid through a shearing action which evenly distributes the particles and may, in some cases, reduce the particle size before entering the liquid. In the case of water-soluble polymeric chemical additive, the motive liquid is high pressure water. The term "eductor" and "ejector" are frequently interchanged, however in this invention they are not the same thing. Both are considered "jet pumps" that operate in accordance with the well-known Bernoulli equation. Their operation does not involve any moving parts and does not require electrical or mechanical shaft energy input. This greatly increases reliability. A high pressure/low velocity motive liquid is converted into a lower pressure/higher velocity annular orifice. Accelerating the flow of liquid past a suction nozzle in the head of the device delivers and entrains a secondary low-pressure liquid or particle. In the head of the device, some of the kinetic energy of the motive liquid is transferred almost instantaneously to the suction liquid or particles until the mixture achieves a uniform velocity at the low pressure. The velocity of this mixture is then converted into an intermediate pressure, lower than the motive pressure, but higher than the suction pressure.

Figure 5A:
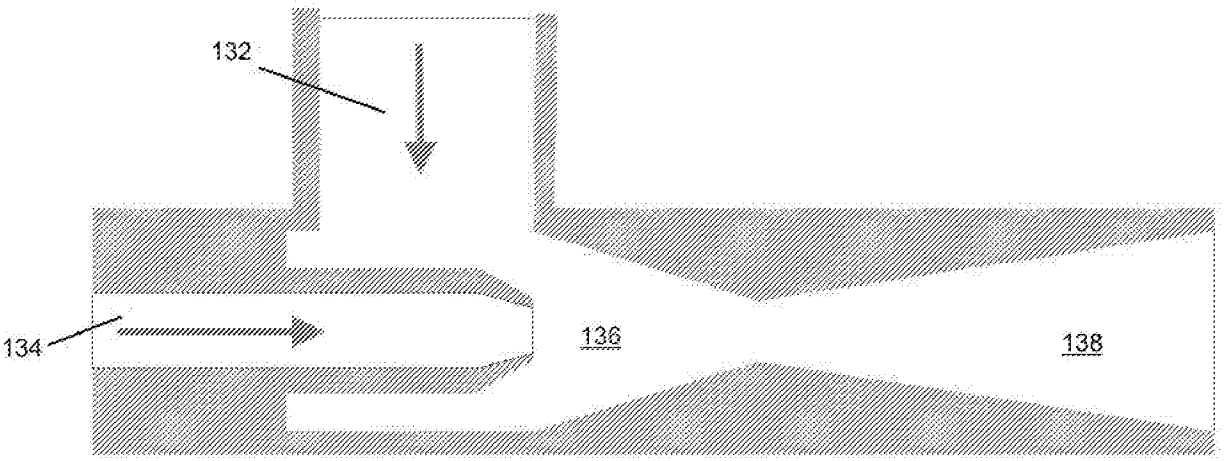
FIG. 5A depicts a prior art eductor nozzle.
Figure 5B:
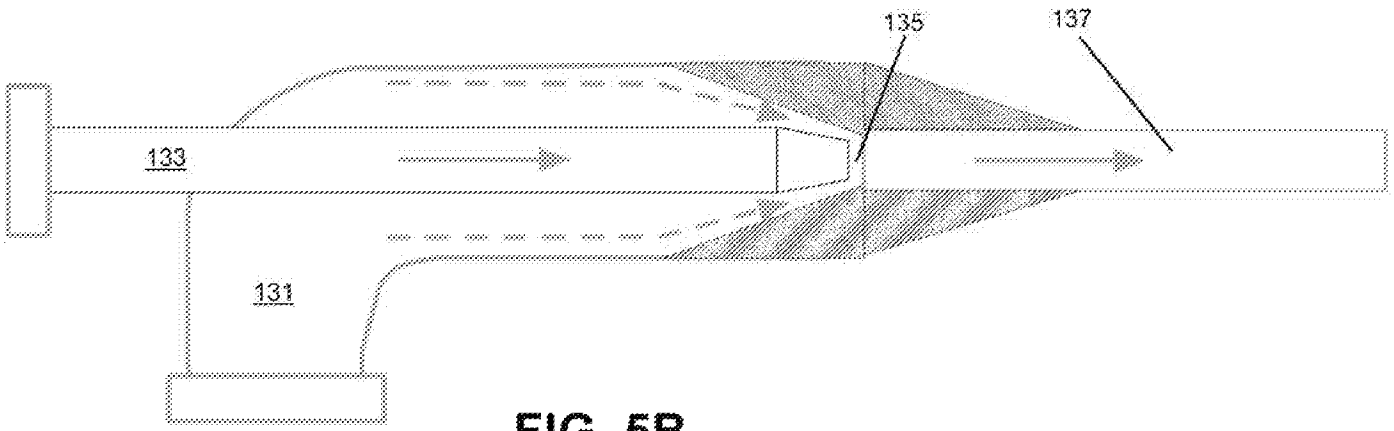
FIG. 5B depicts an embodiment of the ejector nozzle for use with the present invention.

Turning now to FIGS. 5A and 5B, a distinguishing feature of the ejector device (FIG. 5B) versus a traditional eductor device (FIG. 5A) is based in part upon a differentiating characteristic of the flow path of the motive liquid or liquid. The traditional eductor device directs the flow of the motive liquid 134 through a restrictive converging nozzle or orifice 136 which creates a lower pressure region 138 or vacuum as the motive liquid transitions from a high pressure to a lower pressure at the outlet of the nozzle. The lower pressure region 138 immediately downstream of the eductor nozzle 136 provides the suction to draw liquid or solid particles 132 into the high velocity liquid or liquid stream 134. The eductor nozzle 136 is always a converging nozzle which serves to accelerate motive liquid or liquid velocity at the outlet of the nozzle. When used to mix or blend water-soluble polymeric chemical additives, however, the eductor nozzle fails to achieve a consistent dispersion and subsequent hydration of polymer solids often results in the forming of partially wet polymer aggregates. The creation of such agglomerates reduces the functional activity and availability of the polymer additive in the liquid system and can result in damaging conditions if this occurs during well operations.

Alternatively, an ejector device directs the flow of the motive liquid 131 into an annular space 135 located around a center positioned powder conduit 133. The pressurized motive liquid flows through the annular space 135 and travels parallel or tangential to the flow of the powder conduit 133, exiting through a coaxial orifice or radial opening around the outer diameter of the powder conduit 137. The pressure drop created by the flow of liquid through and out of annular space 135 creates a vacuum at the opening of the powder conduit 137. There is a corresponding acceleration of the liquid or liquid velocity near the opening of the powder conduit 137. The degree of vacuum can be manually or remotely adjusted up or down, modifying the rate of powder addition into the liquid. The vacuum can also be adjusted up or down by modifying the volumetric rate of motive liquid 131 or by changing the cross-sectional area of the orifice 135.

The traditional eductor used to add powders or liquids into working liquids in the oilfield is based upon transferring a considerable volume of liquid from high pressure to low pressure with a higher compression ratio, much greater than an ejector device. The greater the pressure differential when comparing the upstream pressure to a point immediately downstream of the eductor nozzle, the greater the volume of liquid or solids that can be educed into the working liquid. Alternatively, the ejector draws in or sucks the excess volume of the system and maintains a system pressure accurately. Ejectors were first developed for and are commonly used in steam applications. Later, it was discovered ejectors were effective in dispersing fire retardant materials into water for fire-fighting operations, and also in dispersing and dissolving sugar for beverage companies.

Unlike the traditional powder eductor used in the well service operations, the preferred apparatus flows a liquid through an annular channel around an inner conduit. The liquid motive force is not directed to flow through the ejector nozzle. Unlike the eductor device the preferred ejector is constructed in such a way that the motive liquid can flow in an annular space around the solids conveying conduit. The inner positioned conduit is conveying the air-powder mixture to a powder ejector nozzle or orifice terminating at the end of the inner conduit. The motive medium or liquid traveling in the annular space around the suction conduit is what drives the ejector and creates a vacuum. The liquid is always injected at an elevated pressure above the pressure of the suction medium. The ejector can be motivated by any liquid up to a certain viscosity level. In the case of well frac, well stimulation and well drilling fluids the preferred motivating liquid is water. In special cases the driving or motivating medium can include air, steam, hydrocarbons or natural gas.

The suction medium of the ejector can be liquids, gasses, solids or a mixture thereof. The only limitation with the suction medium is viscosity and particle size. Depending upon the particular ejector used and the flow rate of the motivating liquid there is a maximum for viscosity and particle size of the powder traveling through the air-powder conduit. The ejector device can be constructed from a variety of construction materials, including: plastic; carbon fiber; stainless steel; carbon steel; cast iron; bronze; and aluminum.

Preferred dispersion ejector devices may be sourced from Semi Bulk Systems, Inc. located in Fenton, Mo., or Ellehammer located in Denmark, or Teamtec Marine in Norway. The force of the motivating liquid traveling through the coaxial orifice creates a high liquid velocity liquid region immediately adjacent to the point at which the powder aerosol is discharged from the powder discharge point. The vacuum created by the force of the motive liquid draws the conditioned powder into direct contact with the high velocity liquid which may be an aerosol liquid stream. The degree of vacuum can change as greater or lesser amount of powder is dispersed into the liquid stream. The Venturi effect applies when a liquid under pressure flows through a constricted section of a pipe. In this invention the liquid passing through the coaxial orifice exits the orifice into a lower pressure or ambient atmospheric pressure vessel. The reduction in liquid pressure results when the motive liquid flows through a constricted coaxial orifice and then is released to atmospheric pressure. The pressurization of the pressurized liquid is created by pumping the liquid at elevated pressure and having the pumped liquid flowing through the restriction of the coaxial orifice, then the release of the pressure is created by the open unrestricted flow of the motive liquid downstream of the coaxial orifice into an atmospheric pressure liquid vessel. The reduced pressure or vacuum region created downstream of the coaxial orifice draws the conditioned powder from the center positioned conduit evenly and in direct contact with the motive liquid. The liquid and powder mix in a turbulent flow regime immediately downstream of the point at which they are mixed and upstream of the release into the atmospheric pressure vessel. The release into the atmospheric pressure vessel allows the entrained air to escape from the liquid. This invention takes advantage of the unique characteristics of an ejector device to accurately meter and completely disperse and hydrate high molecular weight polyacrylamide on a mobile powder dispersion application trailer. There are no other mobile powder dispersion hydration units used in the oilfield well completion, well stimulation or well fracture operations making use of the ejector principle as an integrated process system.

Figure 6:
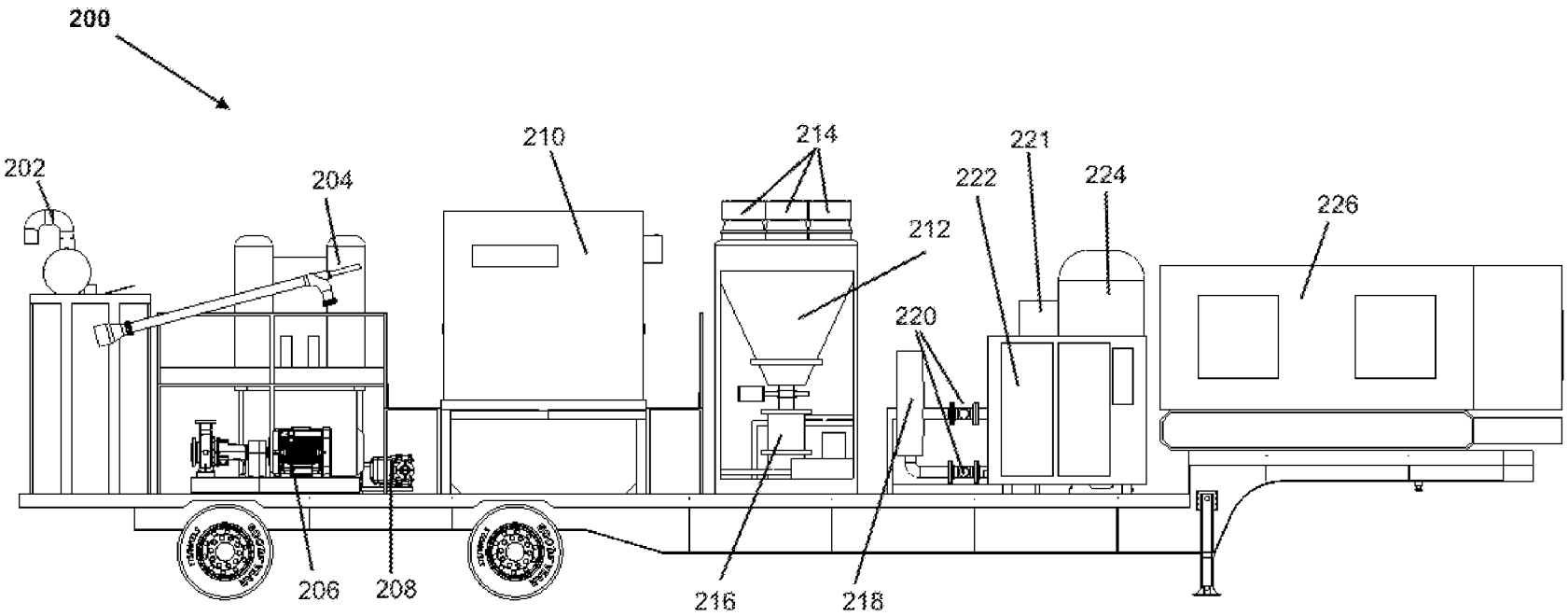
FIG. 6 depicts an embodiment of the mobile powder blending trailer for transporting the present invention.

Turning now to FIG. 6, an embodiment of the powder blend trailer 200 is depicted. Dry powder is received from powder transport bins or may be received in bulk through a conduit 202 connected to separate powder transport trailers (not shown). The powder is conveyed via conduit with airflow from a blower or compressor 206 and drier 208 through pump 210 into powder bin 212, where it is fluidized by the air movement from the bottom up and out through filters 214 retaining powder in powder bin 212. The electrical power for pumps, lights, control systems, and other electrically powered system components is provided by an onboard generator 204. Screw feed 216 delivers powder through the flexible conduit 218 into one or more powder ejector devices 220 so as to facilitate adding one or more chemical additives into a water or liquid stream. In an embodiment, multiple powders can also be added simultaneously into a single ejector device by connecting the powder suction line to one or more powder bins 212. The fluid or water is pumped from a source into a pipe or conduit upstream and leading to the ejector nozzle using pump 210. Accurate individual metering of the individual powders being commingled into the powder eductor conduit or pipe can be achieved by individual rotary air lock valves, screw feeders or other powder metering device. The powder-liquid stream leaving the ejector device(s) 220 is conveyed via conduit 228 to an atmospheric pressure hydration tank 222. The atmospheric hydration tank is fit with an air/liquid cyclone separator 224 to effectively separate the liquid from the air entering the atmospheric hydration tank from the ejector(s) 220. In an embodiment, the water-dispersed powder is directed over and through a perforated plate or corrugated and perforated or slotted plate assembly so the polymer containing liquid is evenly distributed in the liquid stream carrying the powder over the surface of the receiving liquid held in the atmospheric pressure hydration tank 222. Operator cabin 226 allows for local control; although in an embodiment, the control may be entirely remote via electronic, wireless data transfer from sensors to a remote controller. In another embodiment, the hydration tank 222 may be equipped with an injection pump 221 which applies further liquid additives (e.g., defoamers) to the air/liquid mixture either in the tank 222 or in the cyclone separator 224.

An aspect of this invention is the novel and unique approach to employ a process with the ability to draw multiple supplies of conditioned free-flowing powder into a single ejector device. An aspect of this invention is it can combine and blend or mix all chemical additives powders and utilize one or more ejector devices and eliminate the need to transport and store liquid chemicals at the storage warehouse and the oilfield operations job application site.

The performance of this invention provides a complete dispersion leading to nearly an immediate hydration of high molecular weight water-soluble polyacrylamide polymers, even at higher than normal addition rates. Table 1 below illustrates the operating conditions of the powder ejector apparatus using a water-soluble polyacrylamide and water as the liquid. The table illustrates the hydrated flow rate at varying active polymer concentrations (0.4 to 0.9 wt %) as well as equivalent dry polymer loadings. These equivalences are based upon using a dry powder polyacrylamide emulsion at 9.14 pounds per gallon with a powder activity of 30% wt (active).

TABLE 1

| Hydrated Polymer Flow Rate (bbl/min) @ 100 bbl/min | | | | | |
|---|---|---|---|---|---|
| | Polymer wt % | | | | Powder Rate |
| GPT Loading | 0.4 | 0.6 | 0.8 | 0.9 | (lb/min) |
| 0.5 | 4 | 2.72 | 2.04 | 1.81 | 5.75 |
| 1.0 | 8 | 5.45 | 4.08 | 3.62 | 11.51 |
| 1.5 | 12 | 8.17 | 6.12 | 5.43 | 17.27 |
| 2.0 | 16 | 10.89 | 8.15 | 7.24 | 23.03 |
| 2.5 | | 13.62 | 10.19 | 9.05 | 28.79 |
| 3.0 | | 16.34 | 12.23 | 10.86 | 34.54 |
| 3.5 | | | 14.27 | 12.67 | 40.30 |
| 4.0 | | | 16.31 | 14.48 | 46.06 |
| 4.5 | | | | 16.29 | 51.82 |
| 5.0 | | | | 18.10 | 57.58 |

Field testing of the powder ejector nozzle device used in this invention was performed using fresh water and additionally with an API brine water. Each test required 5 pounds per minute of polyacrylamide powder. A high activity polymer solution was generated while simultaneously adding dilution water to the receiving atmospheric vessel. The viscosity measurement was taken on the discharge of the centrifugal circulation pump to observe if the polymer experienced any shear degradation. In both the fresh water test and the API brine test, no evidence of shear was observed. The fresh water resulted in a viscosity of 614 centipoise and the API brine resulted in a viscosity of 83 centipoise. From the pilot test it was observed a higher initial viscosity was achieved in fresh water and API brine than was observed in typical lab waring blender testing of polymer in water. From these experiments it is obvious a greater amount of the polymer is hydrated in a shorter time interval which is observed by a higher viscosity measurement in a shorter period of time.

While various embodiments usable within the scope of the present disclosure have been described with emphasis, it should be understood that within the scope of the appended claims, the present invention can be practiced other than as specifically described herein.

The invention claimed is:

1. A system for dispersing a powder additive within a liquid stream comprising:

at least one transport bin or transport conduit containing the powder additive and in fluid communication with an air source, the air source conveying the powder additive from the at least one transport bin or transport conduit;

at least one powder transfer bin receives the powder additive from the at least one transport bin or transport conduit, wherein the at least one powder transfer bin comprises an air-powder conditioner conveying air upwards from a base of the at least one powder transfer bin;

a powder conduit receives conditioned powder additive from the at least one powder transfer bin;

an ejector device comprising a liquid conduit, concentric with the powder conduit, located within the liquid conduit, wherein the powder conduit terminates before an annular space of the ejector device, wherein the liquid flows past the powder conduit terminus into the annular space and creates a vacuum which urges the conditioned powder additive out of the powder conduit and disperses it within the liquid to form a mixed liquid, a hydration tank receives the mixed liquid from the ejector device; and a transfer pump pumps the mixed liquid from the hydration tank.

2. The system of claim 1, wherein the powder transfer bin comprises at least one filter located at the top of the powder transfer bin, wherein the at least one filter prevents the conditioned powder from ejection into the ambient environment.

3. The system of claim 1, further comprising at least one load cell for measuring weight transferred to the powder transfer bin.

4. The system of claim 1, further comprising a powder feed hopper adjacent to the powder transfer bin, and a valve selectively permitting conditioned powder to flow from the powder transfer bin into the powder feed hopper.

5. The system of claim 4, further comprising a screw feed device located beneath the powder feed hopper, wherein the screw feed device conveys conditioned powder from the powder feed hopper into the powder conduit.

6. The system of claim 1, wherein the powder transfer bin further comprises a rotary air lock valve beneath the powder transfer bin, the rotary air lock valve comprising a plurality of rotors driven by a motor, and wherein each rotation of the rotors transfers a volume of conditioned powder from the powder transfer bin to the powder conduit.

7. The system of claim 6, wherein the rotary air lock valve is in fluid communication with the conveying air source.

8. The system of claim 1, further comprising a dryer between the air source and the powder transport bin.

9. The system of claim 8, wherein the air is dried to a dew point of −40 ° C. or less.

10. The system of claim 1, wherein the hydration tank is open to ambient pressure and temperature.

11. The system of claim 10, wherein the hydration tank further comprises an air/liquid separator, wherein the air and liquid are separated downstream from the ejector, and wherein the air is allowed to escape from the hydration tank.

12. The system of claim 11, wherein the hydration tank further comprises an injection pump, wherein the injection pump applies a defoaming agent to the mixed liquid as it enters the air-liquid separator.

13. The system of claim 1, further comprising a trailer, the trailer comprising at least one operator cabin, and wherein the powder transfer bin, powder conduit, ejector, hydration tank, and transfer pump are all located on the trailer.

14. The system of claim 1, wherein the powder comprises a polyacrylamide.

* * * * *